United States Patent [19]

Sheppard

[11] 4,040,382

[45] Aug. 9, 1977

[54] INDICATOR FOR RELAY OR THE LIKE

[76] Inventor: Howard H. Sheppard, 7430 Sprague St., Philadelphia, Pa. 19119

[21] Appl. No.: 695,286

[22] Filed: June 11, 1976

[51] Int. Cl.[2] ..... G08B 5/34

[52] U.S. Cl. ..... 116/124 L; 340/376

[58] Field of Search ..... 116/124 L, 124 R; 335/17; 340/376, 373; 200/321, 327, 308

[56] References Cited

U.S. PATENT DOCUMENTS 935,935 10/1909 Smith ..... 340/376

FOREIGN PATENT DOCUMENTS 513,502 10/1939 United Kingdom ..... 340/376

*Primary Examiner*—S. Clement Swisher
*Assistant Examiner*—Denis E. Corr
*Attorney, Agent, or Firm*—Michael F. Petock

[57] ABSTRACT

An indicator for an electrical device such as a relay or the like is disclosed for indicating the condition of the contacts in the relay or similar device having a contact operator element movable inwardly with respect to the casing when the relay is operated. An indicating element is slidably mounted in a guide means with the indicating element being movable between a first and a second position within the guide means. Means is provided for holding the indicating element in the first position until the relay is operated. The holding means includes mechanical stop means and magnetic means for insuring positive engagement between said indicator element and said mechanical stop means. Movement of said contact operator element inwardly with respect to the relay casing causes disengagement of the indicating element by said holding means thereby allowing said indicating element to move from said first position to the second position thereby indicating operation of the relay or other electrical device. The indicating element may be provided with a cover which allows viewing of the indicator element only when the indicator element is in one of the two positions. The indicator element is preferably moved from the first position to the second position by means of gravity. The indicator element in the second position prevents resetting of the relay until the indicator element is moved back to its first position.

18 Claims, 9 Drawing Figures

FIG. 1
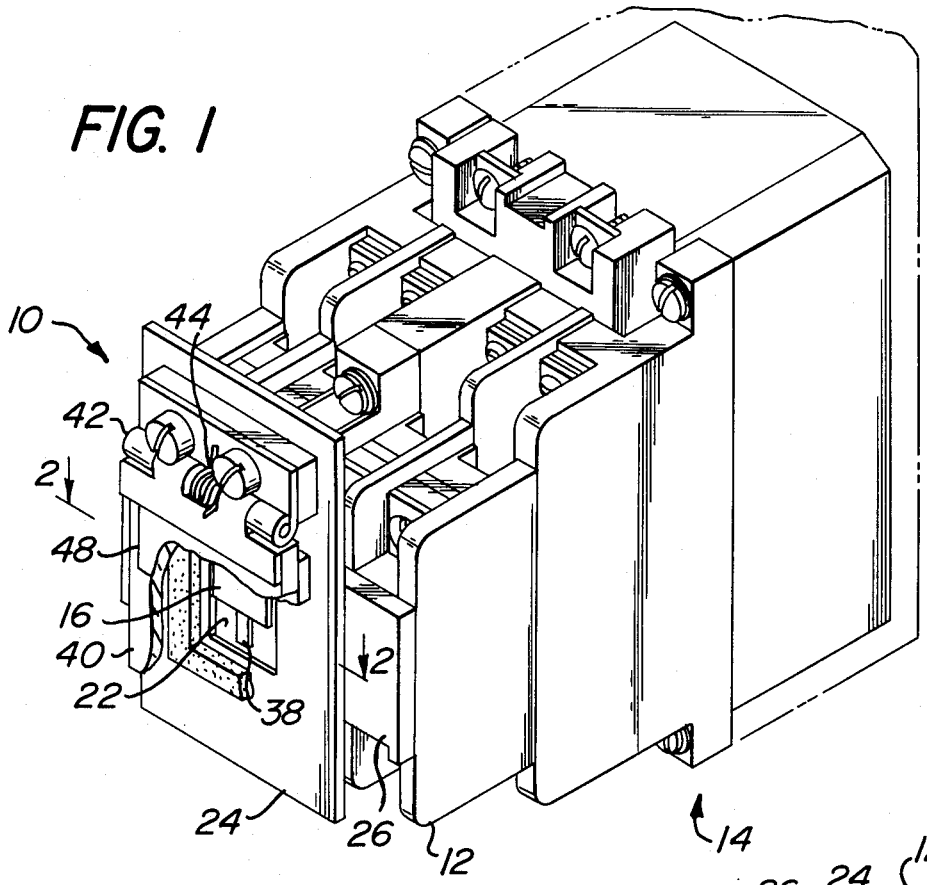
FIG. 2
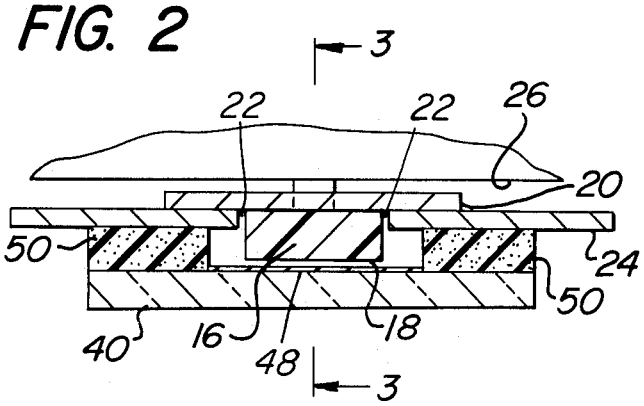
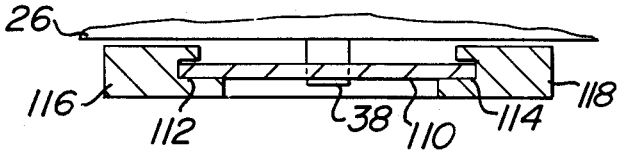
FIG. 9
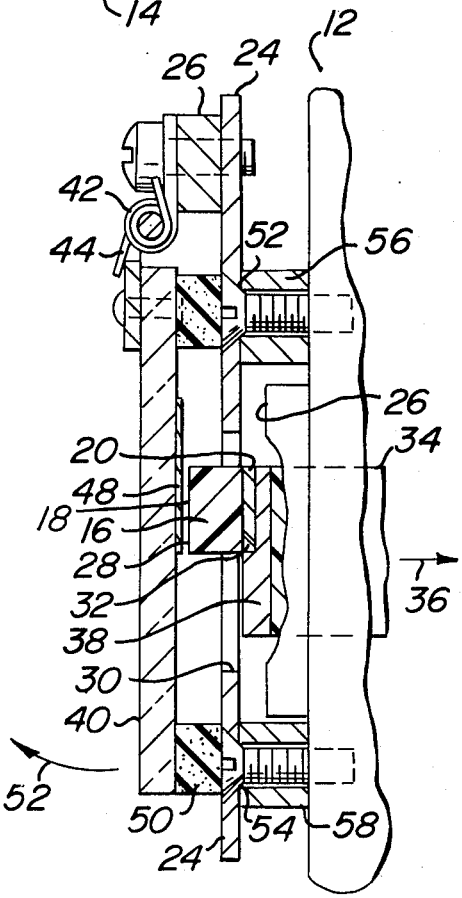
FIG. 3

FIG. 4
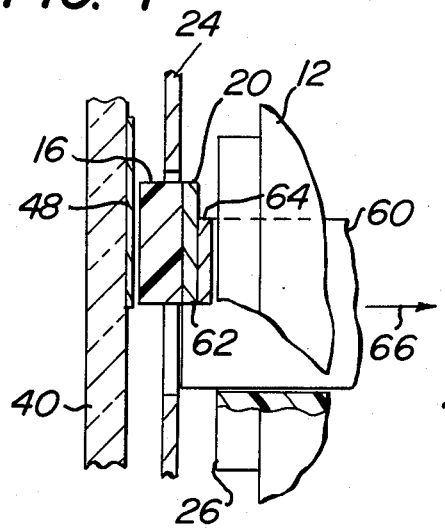
FIG. 5
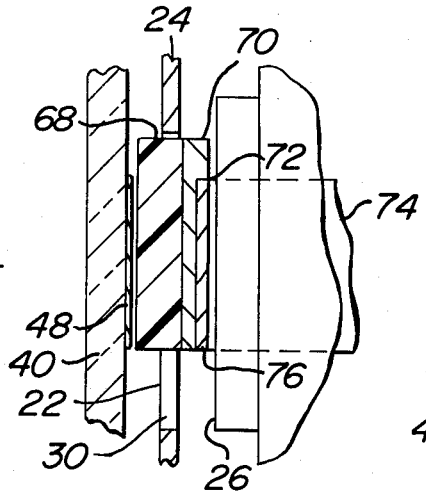
FIG. 6
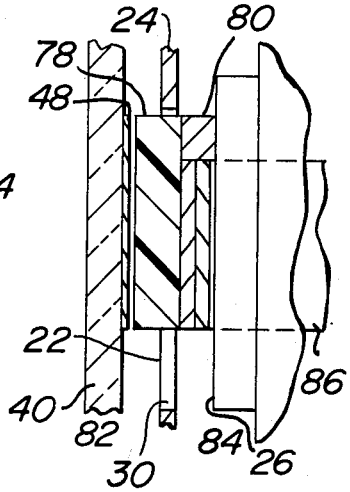
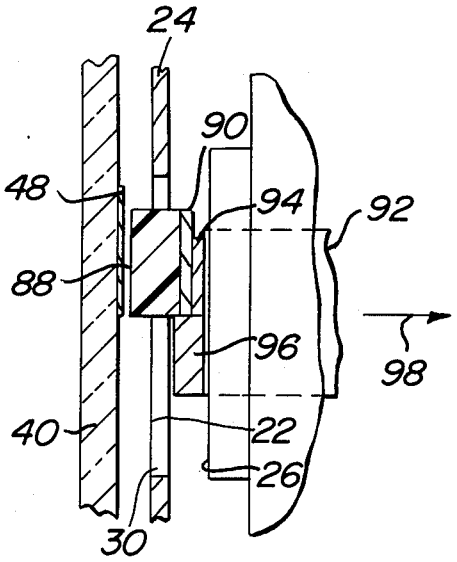
FIG. 7
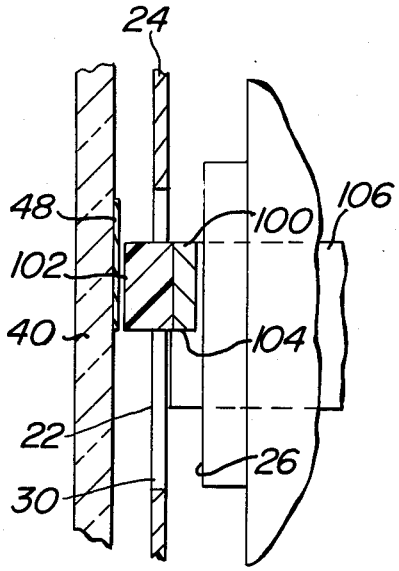
FIG. 8

INDICATOR FOR RELAY OR THE LIKE

BACKGROUND OF THE INVENTION

The present invention is directed to an indicator for an electrical device such as a relay or the like. The electrical device will be referred to herein as a relay, but it is understood that the indicator assembly disclosed and claimed herein may be used on any similar electrical device.

There has been a need for a reliable indicator for the condition of contacts in a relay wherein the indicator does not substantially affect the operation, and particularly the speed of operation of the relay. There has also been a need to provide such an indicator for relays and equivalent electrical devices in which a clear visual indication is provided of the condition, operated or unoperated, of a relay. It is also desirable to provide a means in the indicator assembly wherein the contacts of the relay cannot be reset until the indicator element is moved back to its original position, indicating relay contacts in their unoperated state or that the relay is not energized. There has also been a need to produce a relay which is highly reliable and which does not require a separate solenoid for operation, hinges, pivot means, springs or other elements which may require periodic maintenance.

In a particular application of the present invention, there is a need in the field of high speed protective relaying utilized by the electric utility companies to provide an indicator which will indicate the condition of such high speed protective or auxiliary relays witout slowing down the operation of the high speed relays. The protective or auxiliary relays are usually not operated, but are only operated when a fault, overload, open circuit, or other abnormality occurs. When a fault does occur it is desired that the relays operate very rapidly. Therefore, a protective or auxiliary relay may not be operated for a period of several years, but if a fault occurs, relay operation is required in a fraction of a second. Therefore, it is important that any indicator for the operated or unoperated condition of the relay contacts be operated from the relay contact operator in such a manner so as to avoid any slowing down of the action of the contact operator element and that elements which may result in friction in operation be eliminated. It is desirable to keep the loading of the contact operator element or the force required to be exerted by the contact operator element at a minimum.

Indicators which would utilize the structure such as spring charged latches to hold their targets in place are undesirable since such latches require considerable force on the part of the contact operator to produce unlatching when the relay is operated. Also, such spring loaded latches and other complicated mechanical structures tend to "hang up" or fail to operate as required for any number of various reasons, such as hinge pivots and latch mechanisms become "stiff" due to corrosion caused by non-use over long periods of time. However, it is highly desirable to provide an indicator which will not produce false indications caused by vibrations or other local disturbances, such as large trucks passing by or local blasting, when the relay has not been operated.

SUMMARY OF THE INVENTION

The present invention is directed to an indicator for an electrical device such as a relay or the like for indicating the condition of the contacts therein. Such relay or other electrical device may be of any suitable type having a contact operator element movable inwardly with respect to the casing of the electrical device or relay operated. The present invention provides a visual indication by means of an indicator element as to whether or not the contacts of the electrical device have been operated.

Another advantage of the present invention is that the relay cannot be reset until the indicator element has been returned to its original position indicating the relay is in its unoperated position.

Another advantage of the present invention is that the possibility of the indicator element being accidentally moved due to vibration, shock, or seismic disturbance to thereby give a false indication is very substantially reduced or eliminated.

Another advantage of the present invention is that it provides an indicator which will operate properly to give proper indication even though the relay operates very rapidly. This provides a significant advantage since other known types of indicators do not operate consistently correctly due to the very fast operation of the relays to which they are attached.

Another advantage of the present invention is that it does not require a separate solenoid for operation of the indicator element and does not require the use of one or more contacts of the relay to operate any such additional indicator solenoid.

Another advantage of the present invention is that the indicator has negligible effect on the operation and particularly the speed of operation of the relay. Substantial loading of the contact operator element of the relay could slow down the speed of operation of the relay, and this is avoided by the present invention. This aspect is very important in the present day utility industry as high speed protective relaying is necessary in order to reduce the possibility of blackouts or large scale power failures.

Another advantage of the present invention is that no periodic maintenance, such as lubrication and adjustment, is required.

Briefly and basically, in accordance with the present invention, an indicator is provided for an electrical device such as a relay or the like for indicating a condition of the contacts therein, said electrical device having a contact operator element movable inwardly with respect to a casing or housing of the electrical device when the electrical device is operated. A guide means is provided on the relay casing for slidably mounting an indicating element. The indicating element is movable between a first and a second position within the guide means. Means operable by the contact operator element of the electrical device is provided for holding the indicating element in the first position within the guide means. The holding means includes a mechanical stop means and magnetic means for insuring positive engagement between the indicator element and the mechanical stop means. Movement of the contact operator element inwardly with respect to the casing of the electrical device causes disengagement of the indicating element by the holding means whereby the indicating element may move from the first position to the second position indicating operation of the electrical device.

BRIEF DESCRIPTION OF THE DRAWINGS

For the purpose of illustrating the invention, there are shown in the drawings forms which are presently preferred; it being understood, however, that this invention is not limited to the precise arrangements and instrumentalities shown.

FIG. 1 is a view in perspective of an indicator in accordance with the present invention attached to a relay.

FIG. 2 is a cross-sectional view taken along line 2—2 of FIG. 1.

FIG. 3 is a cross-sectional view taken along line 3—3.

FIG. 4 is a cross-sectional view of an alternate embodiment of the present invention.

FIG. 5 is a cross-sectional view of another alternate embodiment of the present invention.

FIG. 6 is a view in cross-section of another alternate embodiment of the present invention.

FIG. 7 is a view in cross-section of another embodiment in accordance with the principles of the present invention.

FIG. 8 is a cross-sectional view of another embodiment in accordance with the principles of the present invention.

FIG. 9 is a cross-sectional plan view of another embodiment of the present invention showing an alternate guide means for the indicator element in accordance with the present invention.

DETAILED DESCRIPTION OF THE PREFERRED EMBODIMENTS

Referring now to the drawings in detail, wherein like numerals indicate like elements, there is shown in FIG. 1 an indicator for indicator assembly 10 mounted on the casing or housing 12 of a relay or other similar electrical device 14.

Referring now to FIGS. 1, 2 and 3 collectively, there is shown an indicator element 16 having a visible, preferably brightly colored element 18 and a support or guide plate 20. The projecting visible element 18 of indicator element 16 projects through and rides a slot 22 formed in mounting support and guide plate 24. Support or guide plate 20 of indicator element 16 rides mounting support and guide plate 24 and between mounting support and guide plate 24 and the front end 26 of relay casing 12. Indicator 16 is slidably mounted by the guide means comprised of plates 20 and 24 and the front end 26 of housing 12 between a first position as shown in FIGS. 1 and 3 at 28 and a second position in which the lower end of indicator 16 would be abutting the lower end 30 of slot 22. In other words, indicator element is movable between a first position which is preferably substantially vertically above a second lower position whereby the indicator element 16 may fall to the second position when released. Preferably, the relay is arranged so that the first position is substantially vertically above the second position thereby utilizing gravity to move indicator element 16 from the first position to the second position. However, it is understood that other suitable mounting positions may be utilized by providing a spring biasing force biasing indicator element 16 towards the second position. However, this has disadvantages in that the spring is an additional mechanical element and even more importantly, the use of a spring would limit the selectable distance between the first and second positions.

Indicator element 16 is held in the first position 28 when the relay is not or has not been operated by means of a notch, edge or lip 32 operably mounted on a contact operator element 34 which is physically connected to the operating mechanism to operate the contacts of relay 14 and moves in the direction of arrow 36 when relay 14 is operated. The notch or lip 32 on the end of contact operator element 34 is a means for holding indicator element 16 in the first position against the force of gravity. As indicated previously, in the preferred embodiment and usual method of mounting electrical devices such as relay 14, contact operator element 34 would be mounted in a horizontal position to move in the direction of arrow 36 in a horizontal direction, thereby allowing the first position of indicator element to be vertically above the second position.

The means for holding indicator element 16 in the first position preferably comprises both a lip or notch 32 and a magnetic force to cause positive engagement of indicator element 16 in the notch, lip or mechanical stop means 32. The mechanical stop means 32 is, as shown in FIG. 3, formed in a permanent magnet or magnetic material 38 preferably by machining in order to provide a smooth surface on lip 32. For purposes of the present invention, it is desirable that there be a magnetic attraction between element 38 and indicator element 16 to provide the positive engagement. This magnetic attractive force is presently preferably generated by making element 38 a permanent magnet and support or guide plate 20 being made of a magnetic material, such as well known ferrous materials. The permanent magnet 38 may be any conventional permanent magnetic material and is presently preferred to be a permanent magnetic material commercially available as "ALNICO 5." However, it is understood that guide plate 20 may be made of a permanent magnet and element 38 comprised of a magnetic material, or, in the alternative, both plate 20 and element 38 may be permanent magnets.

Holding means element 38 may be fastened to contact operator element 34 by any suitable adhesive or other suitable fastening means. Operator element 34 is usually comprised of a dielectric material and is usually one of the synthetic plastics. Preferably, the adhesive may be a cyanoacrylate adhesive sold commercially under the trademark "EASTMAN 910" or an epoxy type adhesive.

There is shown a transparent cover means 40 mounted over slot 22 in mounting support and guide plate 24. Transparent cover means 40 may be any suitable transparent material and may preferably be a transparent synthetic material commercially available under the trademark "LEXAN" or "PLEXIGLAS." Transparent cover 40 is hingeably mounted to plate 24 by means of spring loaded hinge 42 containing spring 44. Hinge 42 is spaced from plate 24 by spacer 26. Transparent cover 49 is provided with an opaque material 48 which hides or obscures indicator element 16 in the first position when the relay is not operated. A resilient seal 50 is provided at or near the circumference of transparent cover 40 and around slot 22. Seal 50 provides an abutting surface for spring loaded transparent cover 40 and also keeps dust, dirt, and other foreign particles out of the indicator assembly, especially when plate 24 continues as a part of a larger housing assembly. The indicator may be utilized on any relay with a plate 24 as shown in FIG. 1 or the relay or other electrical device may be enclosed in another housing in which slot 22 is formed thereby taking the place of plate 24.

Plate 24 is mounted to the casing or housing of relay 14 by means of screws 52 and 54 and spacers 56 and 58. Of course, other suitable means of mounting may be utilized.

In actual use of indicator 10, indicator element 16 is located in a first position as shown in FIGS. 1 and 3 and is obscured from view by opaque material 48. Indicator element 16 is firmly retained in the first position against the force of gravity by means of notch, lip or mechanical stop means 32 of element 38. Indicator element 16 is held firmly engaged in stop means 32 by means of a magnetic force created between plate 20 of indicator element 16 and element 38. As discussed previously, either one of these elements or both of these elements may be permanent magnets, but preferably, element 38 is the permanent magnet with plate 20 being comprised of a magnetic material.

Upon operation of relay 14, by reason of a fault or otherwise, contact operator element 34 is moved inwardly with respect to casing 12 and particularly inwardly with respect to the front end 26 of casing 12. The movement of contact operator element 34 inwardly with respect to casing 12 or the front end of the casing 26 in the direction of arrow 36 causes the movement of element 38 in the direction of arrow 36 and the disengagement of indicator element 16 by the holding means comprised of mechanical stop means 32 and the magnetic force between plate 20 and element 38. The force of gravity caused indicator element 16 to drop from the first position to a second position in which the lower end of indicator element 16 is in contact with the bottom 30 of slot 22. Element 18 of indicator element 16 is preferably a brightly colored plastic material mounted to plate 20. Preferably element 18 is colored red or white or some other bright color to contrast with the background. In the protective relaying stations of public utility companies, large banks of relays are often used. These relays are usually mounted in electrical equipment bays with a large number of relays. Therefore, the indicator of the present invention provides a means for readily identifying at a glance any relay which may have been tripped.

With indicator element 16 in the second position in abutment with lower end 30 of slot 22, the relay 14 cannot be reset since element 38 would be in contact with the backside of plate 20 thereby preventing operator element from returning to the position as shown in FIG. 3. In order to reset the relay and reset the indicator 10, transparent cover means 40 is lifted in the direction of arrow 52 causing it to pivot on spring loaded hinge 42. The indicator element 16 is then moved manually to its first position, as shown in FIGS. 1 and 3, thereby allowing the resetting of relay 14 and the engagement of the holding means for holding indicator 16 in the first position. Transparent cover 40 is then released returning to its position as shown in FIG. 3 with opaque material 48 now obscuring indicator element 16 from view.

Although the mechanical stop means 32 is shown in a preferred form of a ledge, edge, lip or protrusion on element 38, it is understood that other equivalent structures could be used to form this mechanical stop, such as for example, a projecting pin on either contact operator element 34 which mates with a corresponding hole or notch in plate 20, or vice versa, with a projecting pin on plate 20 mating with a hole in element 38. Other equivalent mechanical stop means will be apparent to those skilled in the art.

Referring now to FIGS. 4 through 9, in which elements similar to those in FIGS. 1 through 3 are given similar numbers, but in which changed elements are given new numbers, referring now particularly to FIG. 4, there is shown an indicator element 16 having a plate 18 mounted between the front end 26 of relay casing 12 and guide plate 24. Contact operator element 60 is provided with a lip of indentation 62. Element 64 is mounted to contact operator element 60 in indentation 62. Element 64 may be either a permanent magnet or comprised of magnetic material. Either or both of plate 18 and element 64 may be permanent magnets. If only one of plate 18 and element 64 are permanent magnets, then the other is comprised of a magnetic material. In any event, a magnetic force is provided attracting plate 18 into positive engagement with the mechanical stop 62 provided on contact operator element 60. Indicator element 16 is disengaged from the holding means comprised of mechanical stop means 62 and the magnetic holding means of plate 18 and element 64 when contact operator element 60 is moved in the direction of arrow 66.

Referring now to FIG. 5, there is shown another embodiment of the present invention in which an indicator element 68 is provided with a support or guide plate 70 having an upper lip or projection at 72. The contact operator 74 is provided with an element 76 which may be made of magnetic material or comprised of a permanent magnet. If element 76 is comprised of a permanent magnet, then support or guide plate 70 may be either a permanent magnet or comprised of magnetic material. An important consideration is that there be a magnetic attraction between support or guide plate 70 and element 72. This may be carried by making support plate 70 and element 72 out of permanent magnets or by making either of them a permanent magnet and the other of magnetic material. Element 76 is bonded to contact operator element 74, preferably by a suitable adhesive. When contact operator element 74 is moved in the direction of arrow 66, indicator element 68 is allowed to fall so that the lower end of indicator element 68 comes in contact with the lower edge 30 of slot 22 causing indicator element 68 to be visible through the portion of transparent cover 49 which is not obstructed by opaque material 48.

Referring now to FIG. 6, there is shown another embodiment of the present invention in which an indicator element 78 is provided with a stop projection element 80 which may be comprised or any suitable fairly rigid material, such as aluminum, other metals or synthetic material, and need not be comprised of a permanent magnet or a magnetic material. A piece of magnetic material or a permanent magnet is adhesively fastened to indicator element 78 as element 82. Element 84 is adhesively fastened to contact operator element 86 and is comprised of either a permanent magnet or magnetic material. Similarly, the important consideration with respect to the substance of elements 82 and 84 is that there be a magnetic attraction between these elements, therefore, both of these may be comprised of permanent magnets or one of them may be comprised of a permanent magnet and the other of a suitable magnetic material. Upon operation of the relay, contact operator element 86, with element 84 attached moves in the direction of arrow 66 allowing indicator element 78 to fall wherein the lower end of indicator element 78 comes in contact with the lower end 30 of slot 22 thereby allowing indicator element 78 to be visible through a portion of transparent cover 40 which is not obstructed by opaque material 48.

Referring now to FIG. 7, there is shown another embodiment of the present invention in which an indicator element 88 is provided with a support of guide plate 90. Contact operator element 92 is provided with element 94 which is comprised of a permanent magnet or a magnetic material. Contact operator element 92 is also provided with a lower projecting member 96 which may be comprised of any suitable fairly rigid material, such as aluminum, other metals, or synthetic material. Element 96 need not be comprised of a permanent magnet nor magnetic material. Support or guide plate 90 is fastened to indicator element 88 by suitable means, such as a suitable adhesive. Element 94 is fastened to contact operator element 92 by suitable means such as a suitable adhesive. Both support plate 90 and element 94 may be comprised of permanent magnets or either may be comprised of a permanent magnet with the other comprised of a magnetic material. When contact operator element 92 is moved in the direction of arrow 98, indicator element 88, with support or guide plate 90 attached thereto, is allowed to fall so that the lower end of indicator element 88 comes in contact with the lower end 30 of slot 22 thereby allowing indicator element 88 to be visible through a portion of transparent cover 40 which is not obstructed by opaque material 48.

Referring now to FIG. 8, there is shown another embodiment of the present invention in which the magnetic force is not used. Although it is preferred that the mechanical stop means be combined with a magnetic holding force, it is understood that it is possible to eliminate the magnetic holding means in certain applications with a resulting saving in cost. In FIG. 8, there is shown an indicator element 102 with a support or guide plate 100 mounted thereon. A notch, lip or mechanical stop 104 is formed or machined in contact operator element 106. When contact operator element 106 is moved in the direction of arrow 98, contact indicator element 102 with support or guide plate 100 is allowed to fall in slot 22 with the lower end of indicator element 102 coming in contact with the lower edge 30 of slot 22 thereby causing indicator element 102 to be visible through a portion of transparent cover 40 which is not obstructed by opaque material 48. It is understood that in this and all of the embodiments shown in FIGS. 4 through 8, that the support or guide plate attached to the indicator element rides behind a portion of plate 24 as previously discussed in the embodiment of FIGS. 1, 2 and 3 thereby forming a guide means with the front end 26 of the relay casing.

Referring now to FIG. 9, there is shown an alternate embodiment of a guide means in which an indicator element 110 is mounted to ride within guides or ways 112 and 114 of supports 116 and 118, respectively. As shown in FIG. 9, the indicator element 110 may be formed without a projecting synthetic member 18 as shown in the embodiment of FIGS. 1, 2 and 3. However, it is understood that indicator element 110 may be comprised of any suitable metal, synthetic material or other suitable fairly rigid material.

The present invention may be embodied in other specific forms without departing from the spirit or essential attributes thereof and, accordingly, reference should be made to the appended claims, rather than to the foregoing specification as indicating the scope of the invention.

I claim:

1. An electrical device such as a relay or the like having means for indicating a condition of the contacts therein, comprising:

a contact operator element movable inwardly with respect to a casing or housing or an electrical device when the electrical device is operated;

guide means for slideably mounting an indicating element, said indicating element being movable between a first and a second position within said guide means; and means operable by said contact operator element for holding said indicating element in said first position, said holding means including mechanical stop means, movement of said contact operator element inwardly with respect to the electrical device casing causing disengagement of the indicating element by said holding means whereby said indicating element may move from said first position to said second position indicating operation of said electrical device.

2. An indicator for an electrical device in accordance with claim 1 wherein said indicating element in said second position prevents resetting of said electrical device.

3. An indicator for an electrical device in accordance with claim 1 wherein said guide means comprises a plate having an aperture therein, said indicating element being provided with a projecting portion projecting through said aperture and riding within said aperture.

4. An indicator for an electrical device in accordance with claim 1 wherein said guide means is comprised of a housing plate with an aperture therein, said indicating element having a projection projecting through said aperture, and said housing being provided with a transparent cover mounted to said housing plate.

5. An indicator for an electrical device in accordance with claim 1 wherein said contact operator is provided with a notch or lip forming said mechanical stop means.

6. An indicator for an electrical device in accordance with claim 1 in which said first position is substantially vertically above said position two when said electrical device is mounted for operation.

7. An indicator for an electrical device such as a relay or the like for indicating a condition of the contacts therein, said electrical device having a contact operator element movable inwardly with respect to a casing or housing of the electrical device when the electrical device is operated, comprising:

guide means for slideably mounting an indicating element, said indicating element being movable between a first and a second position within said guide means; and means operable by said contact operator element for holding said indicating element in said first position, said holding means including mechanical stop means and magnetic means for insuring positive engagement between said indicator element and said mechanical stop means, movement of said contact operator element inwardly with respect to the electrical device casing causing disengagement of the indicating element by said holding means whereby said indicating element may move from said first position to said second position indicating operation of said electrical device.

8. An indicator for an electrical device in accordance with claim 7 wherein said indicating element in said second position prevents resetting of said electrical device.

9. An indicator for an electrical device in accordance with claim 7 wherein said guide means comprises a plate having an aperture therein, said indicating element being provided with a projecting portion projecting through said aperture and riding within said aperture.

10. An indicator for an electrical device in accordance with claim 7 wherein said guide means is comprised of a housing plate with an aperture therein, said indicating element having a projection projecting through said aperture, and said housing being provided with a transparent cover mounted to said housing plate.

11. An indicator for an electrical device in accordance with claim 7 wherein said contact operator is provided with a notch or lip forming said mechanical stop means.

12. An indicator for an electrical device in accordance with claim 11 in which said mechanical stop means and of said contact operator is provided with a permanent magnet and said indicating element is comprised of magnetic material.

13. An indicator for an electrical device in accordance with claim 11 in which said mechanical stop means end of said operator is provided with a magnetic material and said indicating element is provided with a permanent magnet.

14. An indicator for an electrical device in accordance with claim 7 in which said indicating element is provided with a notch or a lip for contacting the mechanical stop end of said contact operator.

15. An indicator for an electrical device in accordance with claim 14 in which the mechanical stop end of said contact operator is provided with a permanent magnet and said indicating element is provided with magnetic material.

16. An indicator for an electrical device in accordance with claim 14 in which the mechanical stop means end of said contact operator is provided with magnetic material and said indicating element is provided with a permanent magnet.

17. An indicator for an electrical device in accordance with claim 14 in which the mechanical stop means end of said contact operator and said indicating element are provided with permanent magnets.

18. An indicator for an electrical device in accordance with claim 7 in which said first position is substantially vertically above said second position two when said electrical device is mounted for operation.

* * * * *